United States Patent [19]

Grace

[11] 4,385,578

[45] May 31, 1983

[54] PLACEMENT AND RETRIEVAL BARGE FOR OFF-SHORE WELL DRILLING

[76] Inventor: Frederick J. Grace, 36 Island Lake La., Naples, Fla. 33962

[21] Appl. No.: 262,186

[22] Filed: May 11, 1981

[51] Int. Cl.[3] ..... B63B 3/02

[52] U.S. Cl. ..... 114/77 A; 405/204; 114/266

[58] Field of Search ..... 114/352, 77 R, 77 A, 114/264, 266, 258, 263; 405/204; 175/7-8

[56] References Cited

U.S. PATENT DOCUMENTS

| | | | |
|---|---|---|---|
| 3,131,542 | 5/1964 | Koch | 114/266 |
| 3,791,080 | 2/1974 | Sjoberg | 114/266 |
| 3,999,396 | 12/1976 | Evans | 114/77 A |

*Primary Examiner*—Charles E. Frankfort
*Assistant Examiner*—Jesus D. Sotelo
*Attorney, Agent, or Firm*—Hauke and Patalidis

[57] ABSTRACT

A placement and retrieval modular barge arrangement for off-shore well drilling equipment comprising at least two separable barge sections having an arrangement for being joined together, each barge section being made of a floatable hull having a deck capable of carrying thereon sections of a blow-out collar or other equipment, the barge having a central opening formed therein for surrounding a well drilling derrick when the barge sections are joined together, each barge section being provided with a radially movable platform arrangement slidably supported in the hull thereof, and an arrangement for actuating the platform arrangement to retract it to the confines of the central opening or extend it therefrom a distance sufficient to support a blow-out collar or other equipment during assembly or disassembly thereof.

5 Claims, 5 Drawing Figures

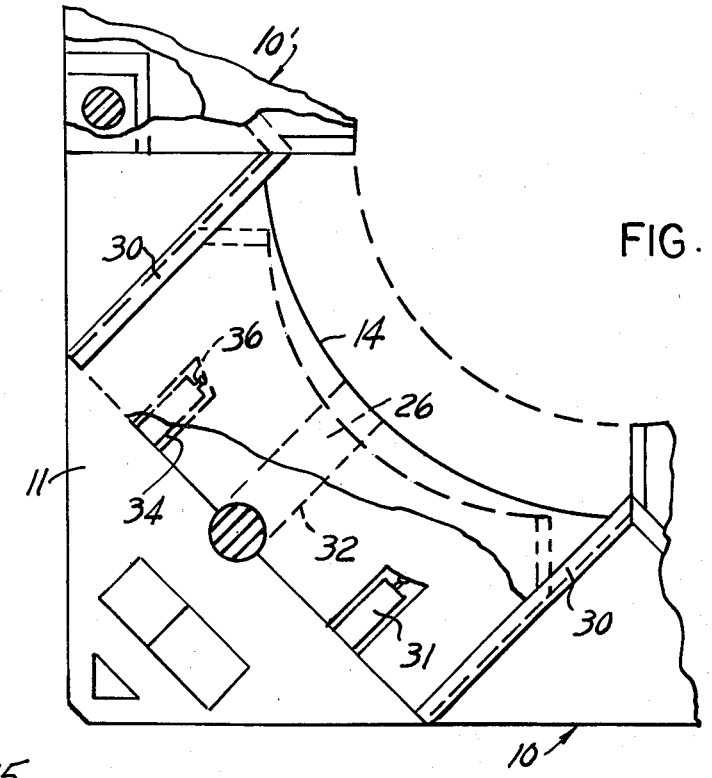
FIG. 2
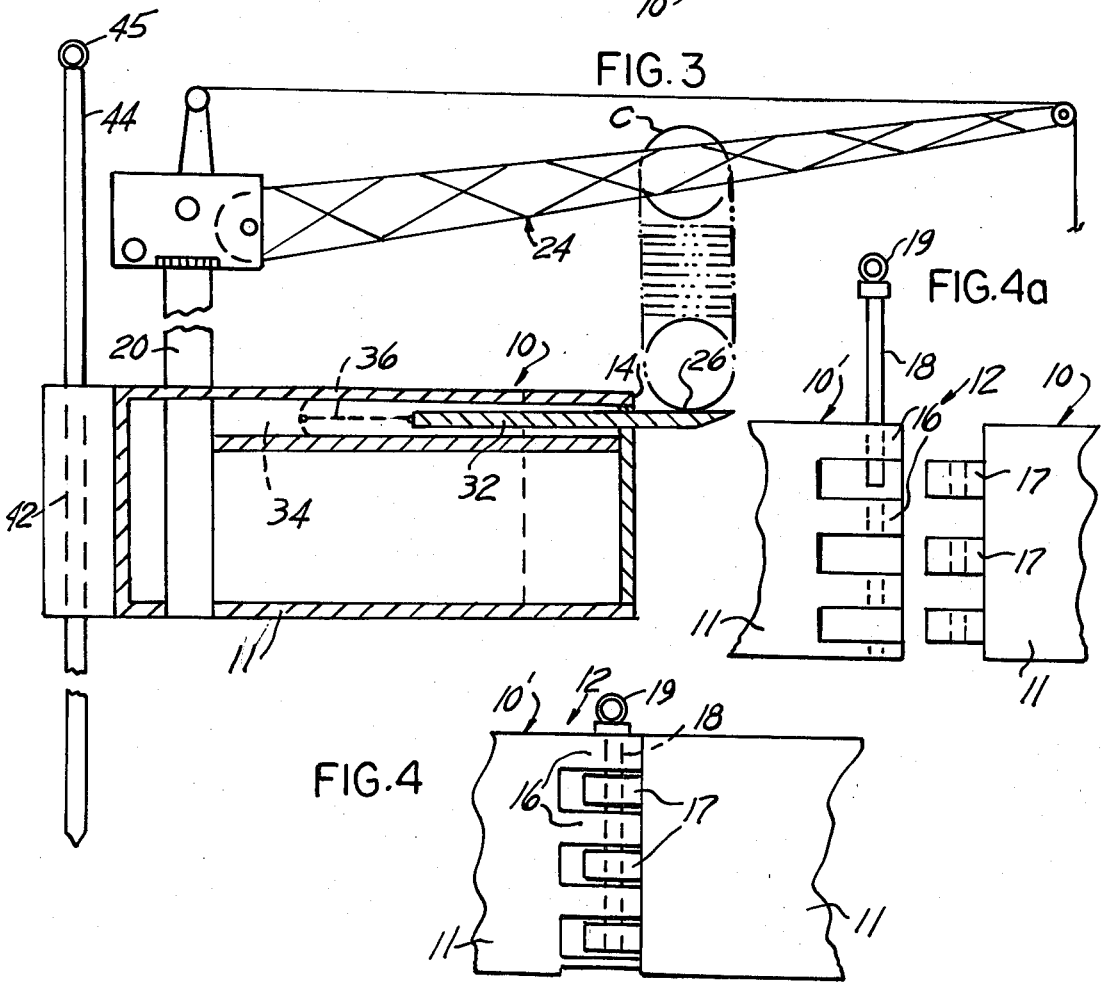
FIG. 3
FIG. 4a
FIG. 4

PLACEMENT AND RETRIEVAL BARGE FOR OFF-SHORE WELL DRILLING

BACKGROUND OF THE INVENTION

The invention relates to means for in situ placement and retrieval of equipment used in off-shore well drilling operations, in general, and more particularly relates to a modular barge system for placement and retrieval of a blow-out collar disposed around an off-shore well for controlling oil leakage.

The foregoing object of this invention and the advantages thereof will become apparent during the course of the following description, taken in conjunction with the accompanying drawings, in which:

BRIEF DESCRIPTION OF THE DRAWINGS

FIG. 2 is a fragmentary plan schematic view thereof showing the work-platform thereof retracted;

FIG. 3 is a fragmentary schematic section from line 3—3 of FIG. 1;

FIG. 4 is fragmentary elevational views thereof from line 4—4 of FIG. 1; and FIG. 4*a* is a view similar to FIG. 4, but showing the modular barge sections disconnected.

DETAILED DESCRIPTION OF THE PREFERRED EMBODIMENT

Figure 1:
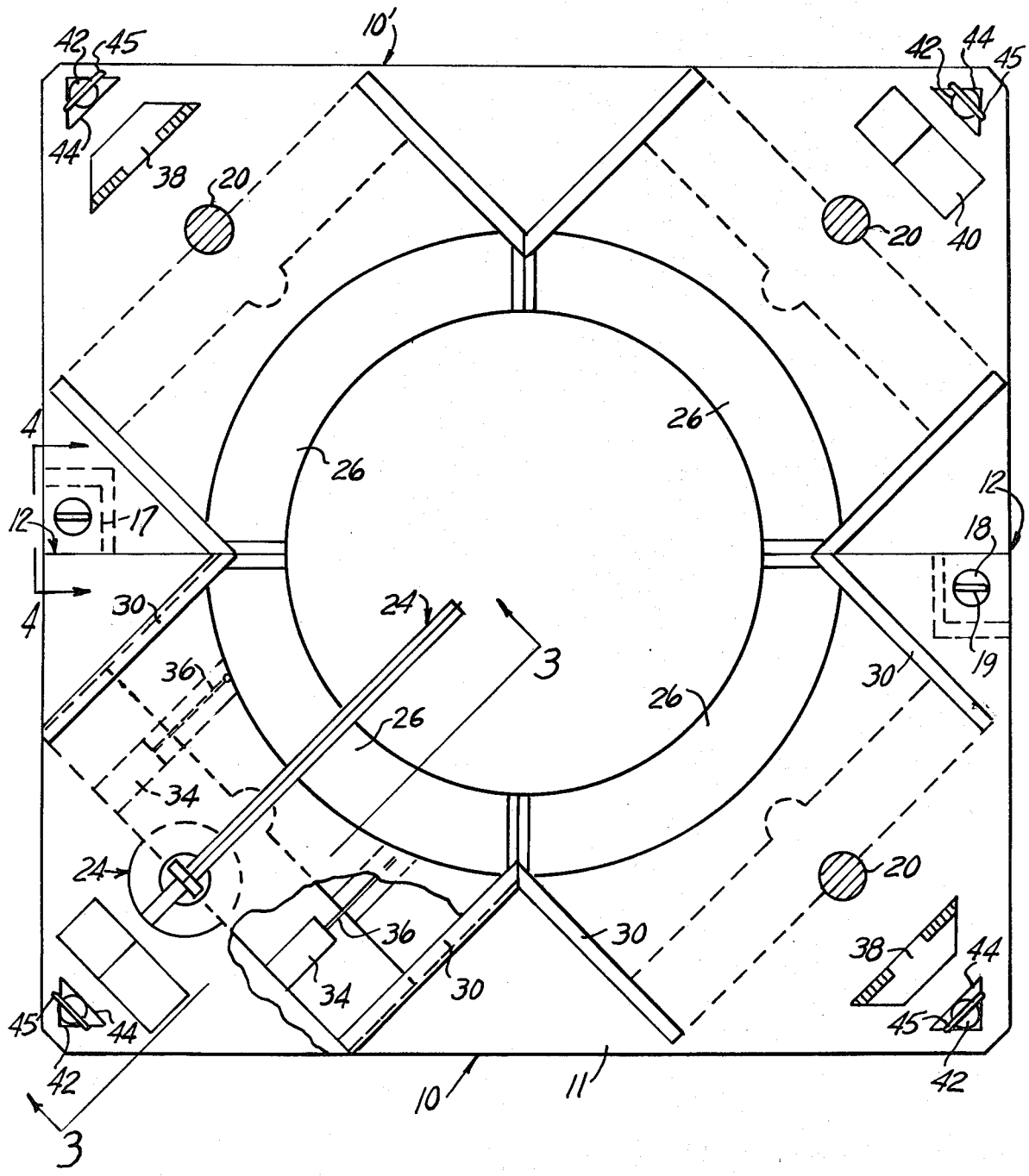
FIG. 1 is a top plan schematic view of a placement and retrieval modular barge system embodying the invention.

Referring to the drawings in greater detail, numeral 10 generally designates a barge section and numeral 10' designates another barge section which each constitutes, in the instance of structure illustrated, one half of the placement and retrieval modular barge system embodying the invention. Each barge section 10 or 10' is made like the hull 11 of a ship and floats. The two barge sections 10 and 10' are joined together, as at 12, and, when so joined, provide a central opening 14 for placement and retrieval of equipment therethrough. The central opening 14 is adapted and intended to surround a well drilling derrick and provide, at its edge, a pollution control curtain or blow-out collar C as described in details in co-pending application Ser. No. 211,829, filed Dec. 1, 1980, by the same applicant as the instant application. As best shown at FIGS. 4 and 4*a*, complementary vertically spaced apart projecting ledges 16 and 17 on each barge section 10' and 10, respectively, interengage to interconnect the barge sections at the junction line or hull split 12 and are locked together by a pin 18 having an eye 19 engageable for lifting by crane.

Each barge section 10 or 10' is provided with a pair of radially movable arcuate platforms 26 which are slidably supported via roller bearings for example, by lateral tracks 30 and control 32 disposed interiorly of the hull 11. Each platform 26 is reciprocated by a pair of fluid operated rams 34 having piston rods 36 connected at their end to the rear of each platform 26. The pair of platforms 26 of each barge section 10 or 10' are actuated by the respective pair of rams 34 and retract within the confines of the central opening 14 or extend therefrom a distance sufficient to support the blow-out collar C as shown in broken lines in FIG. 2.

Each barge section 10 or 10' is provided at its opposite corners with a crane control room 38 and a maintenance and equipment room 40 housing a motor-generator set and an air compressor. A pair of pointed spuds 44 having eyes 45 engageable by crane cables extend vertically through the hull of each barge section 10 via apertures 42 in opposite corners thereof. The spuds 44 are dug into the sea bottom for anchoring the placement and retrieval barges against movement from the sea.

In use of the placement and retrieval barges for placement, for example, of the blow-out collar C, the two barge sections 10 and 10' are floated to the well drilling derrick with sections of the collar C carried thereon. The barge sections 10 are positioned so that the derrick is surrounded by the opening 14 and then locked together by the interengaging ledges 16 and 17 and pins 18. The latter pins are lifted and placed by the cranes 24. The spuds 44 are then inserted into the apertures 42 and driven into the sea bottom. The platforms 26 are extended and sections of the blow-out collar c are lifted by the cranes 24 and placed on the respective extended platform 26. The blow-out collar C is assembled while supported on the platforms 26 and made ready to be placed in the sea. Thereafter the blow-out collar C is lifted by the cranes 24 so that the platforms 26 can be retracted and following such retraction of the platforms 26, the blow-out collar C is lowered into the sea. To retrieve the blow-out collar C, the collar is lifted out of the sea by the cranes 24 above the platforms 26 which are then extended. The blow-out collar C is then lowered onto the extended platforms 26 so that it can be disassembled into sections which are then loaded onto the deck or in the hold of the barge sections 10 and 10'. The platforms 26 are retracted into the hulls 11 of the barge sections 10 and 10', which are then separated by pulling the pins 18. The spuds 44 are also pulled out of the sea bottom so that the barge sections 10 and 10' can be towed away from the well drilling derrick.

It will thus be seen that there has been provided by this invention a placement and retrieval modular barge system in which the object hereinabove set forth, together with many thoroughly practical advantages, has been successfully achieved. While a preferred embodiment of this invention has been shown and described, it is to be understood that variations and changes may be resorted to without departing from the spirit of this invention as defined by the appended claims.

I claim:

1. A placement and retrieval modular barge system for off-shore well drilling comprising at least two separable barge sections having means for being joined together, each barge section being made of a floatable hull having a deck capable of carrying thereon sections of a blow-out collar, said barge system having a central opening formed therein for surrounding a well drilling derrick when said barge sections are joined together, each barge section being provided with radially movable platform means slidably supported in the hull thereof, and means for actuating said platform means to retract it to the confines of said opening or extend it therefrom a distance sufficient to support a blow-out collar during assembly or disassembly thereof.

2. A placement and retrieval modular barge system as claimed in claim 1, further comprising vertically spaced apart projecting ledges on each barge section which interengage to form a junction line for said barge sections and pin means for locking said ledges together.

3. A placement and retrieval modular barge system as claimed in claim 1, wherein said platform means for each barge section comprises at least one arcuate platform, tracks disposed in the hull of said barge section for slidably supporting said platform, and fluid-powered means for reciprocating said platforms.

4. A placement and retrieval modular barge system as claimed in claim 1, further comprising anchor means in each barge section in the form of a vertically extending spud capable of being embedded in the sea bottom.

5. A placement and retrieval modular barge system as claimed in claim 1, further comprising a control room and a maintenance and equipment room carried on the deck of each barge section and at least one crane operative above said deck for lifting sections of said blow-out collar between said platform means and said deck for assembly and disassembly thereof.

* * * * *